US007090007B2

(12) United States Patent
Stuart-Bruges et al.

(10) Patent No.: US 7,090,007 B2
(45) Date of Patent: Aug. 15, 2006

(54) CENTRALIZER FOR WIRELINE TOOLS

(75) Inventors: William P. Stuart-Bruges, Hampshire (GB); Thomas L. Searight, London (GB); Neil G. Harris, Berkshire (GB)

(73) Assignee: Sondex Limited, Hampshire (GB)

( * ) Notice: Subject to any disclaimer, the term of this patent is extended or adjusted under 35 U.S.C. 154(b) by 194 days.

(21) Appl. No.: 10/258,359

(22) PCT Filed: Apr. 20, 2001

(86) PCT No.: PCT/GB01/01790

§ 371 (c)(1),
(2), (4) Date: Jan. 21, 2003

(87) PCT Pub. No.: WO01/81709

PCT Pub. Date: Nov. 1, 2001

(65) Prior Publication Data

US 2003/0145985 A1 Aug. 7, 2003

(30) Foreign Application Priority Data

Apr. 20, 2000 (GB) ..... 0009884.8

(51) Int. Cl.
*E21B 17/10* (2006.01)

(52) U.S. Cl. ..... 166/241.5; 166/214; 175/325.3

(58) Field of Classification Search ..... 166/381, 166/382, 206, 209, 211, 213–217, 241.1, 166/241.3, 241.5, 241.6; 175/325.1–325.3
See application file for complete search history.

(56) References Cited

U.S. PATENT DOCUMENTS 1,898,074 A * 2/1933 Bailey ..... 175/325.7
2,899,633 A * 8/1959 Smith et al. ..... 324/347
3,092,182 A * 6/1963 Blagg ..... 166/241.6
3,568,053 A 3/1971 Kilpatrick
4,557,327 A * 12/1985 Kinley et al. ..... 166/241.5
4,615,386 A 10/1986 Briscoe
4,619,322 A * 10/1986 Armell et al. ..... 166/241.5
4,757,873 A 7/1988 Linyaev et al.
4,776,394 A * 10/1988 Lynde et al. ..... 166/55.8
4,790,381 A 12/1988 Armell
4,830,105 A * 5/1989 Petermann ..... 166/241.1
5,005,642 A 4/1991 Moore
5,094,103 A 3/1992 Wicks, III et al.
5,358,039 A * 10/1994 Fordham ..... 166/241.1

(Continued)

FOREIGN PATENT DOCUMENTS

GB 2 155 519 9/1985

(Continued)

*Primary Examiner*—Jennifer H. Gay
(74) *Attorney, Agent, or Firm*—Flynn, Thiel, Boutell & Tanis, P.C.

(57) ABSTRACT

A centralizer for use in oil well wireline toolstrings comprising a central mounting rod and floating spring mechanisms between which a number of jointed centralizer arms are connected. The jointed centralizer arms have a section with a concave profile disposed near to their pivot points so that a closing force acting on the arms acts at a greater distance from the pivot, thereby increasing the closing moment and making the centralizer easier to draw into a borehole with a narrow cross-section. The floating spring mechanisms also have a linkage to the presser plate of the spring such that an axial force pulling the centralizer apparatus into a borehole is transferred directly into a force on the spring, thereby reducing the opening moment the springs exert on the centralizer arms.

9 Claims, 8 Drawing Sheets

U.S. PATENT DOCUMENTS 5,358,040 A 10/1994 Kinley et al.
5,758,723 A * 6/1998 Saucier et al. ..... 166/55.8
5,785,125 A * 7/1998 Royer ..... 166/380
6,216,779 B1 * 4/2001 Reinhardt ..... 166/57
6,629,568 B1 * 10/2003 Post et al. ..... 166/382
6,658,981 B1 * 12/2003 Rochen et al. ..... 89/1.15
2003/0024710 A1 * 2/2003 Post et al. ..... 166/382

FOREIGN PATENT DOCUMENTS

GB 2 173 533 10/1986
GB 2 268 769 1/1994

* cited by examiner

CENTRALIZER FOR WIRELINE TOOLS

This invention relates to an instrument for centring wireline tools during passage through oil wells. Production logging tools, used by the oil industry, for downhole data collection, are widely known. The tools are adapted to their environment by being compact, slim and generally cylindrical in shape, so that they can fit into the narrowest boreholes and withstand the extreme pressures and rigours of the downhole environment. It is common practice to connect a number of individual tools together longitudinally to create a tool-string with a range of data collection capabilities. The tool-string is drawn through the oil borehole by a cable or wireline connected at both ends. In the case of wireline tools, the wireline is also used to supply power to the toolstring.

Centralizers are commonly used to support wireline tools as they are lowered or raised inside vertical, deviated or horizontally-drilled oil wells. Some tools require to be centred in order to make proper measurements or otherwise perform their intended function, and centralizers are often used to provide a smooth passage along deviated holes, including reliable entry of the tool-string when passing from a large section of borehole into a smaller section.

Centralizers are commonly implemented using bow-springs or spring-loaded linkages, preferably fitted with wheels. Existing designs can have difficulty in entering a small borehole from a larger borehole, since the sprung assembly, which has to be powerful enough to support a heavy horizontal tool-string, has to be squeezed shut in order to pass through a narrower section of borehole. The force which works against the sprung linkage in this way comes from the wireline or cable and is therefore limited by the maximum load that the cable can bear. Resistance to the passage of the wireline toolstring is therefore encountered at sections of the oil well where the diameter suddenly narrows.

U.S. Pat. No. 4,615,386 discloses a linear force centraliser adapted to be supported on a downhole tool. The centralizer includes multiple sets of long and short arms extending outwardly to define a protruding knuckle, the knuckle having a roller adapted to be in contact against the surrounding well borehole. The arms are connected to similar spaced apart, facing crosshead assemblies slideable on a central mandrel. The crosshead assemblies cooperate with first and second spring means. The first spring means increases in resilient force which increases acting on the arm as the arm is deflected radially inward. The second spring means forms a resilient force which increases as the arm is deflected radially outwardly.

U.S. Pat. No. 5,005,642 discloses an apparatus for centralizing an elongated tool in a tubular member. The apparatus has multiple pairs of arms, each arm having one end pivotally mounted on the tool with the opposite ends disposed adjacent to each other. The opposite ends of the arms are pivotally connected and a biasing means is provided for moving the opposite ends of the arms outward to provide the centralizing force. The arms are provided with surfaces that have a gradually curving section which will provide a large inward force while requiring only a slight force to move the housing axially.

We have appreciated that it would be advantageous to provide a centralizer apparatus which by virtue of its design is more easily drawn into small apertures from a larger one, without the efficiency of the centralizer to support the weight of the toolstring in horizontal or near-to-horizontal wells being compromised.

SUMMARY OF THE INVENTION

The invention is defined by the independent claims to which reference should now be made. Advantageous features of the invention are set forth in the appendant claims.

A preferred centralizer for use in oil well wireline toolstrings is described below in more detail with reference to the drawings. Briefly, the centralizer has a central mounting rod and two floating spring mechanisms, between which a number of jointed centralizer arms are connected. The jointed centralizer arms have a section with a concave profile disposed near to their pivot points, so that a closing force acting on the arms acts at a greater distance from the pivot. This has the effect of increasing the closing moment and making the centralizer easier to draw into a borehole with a narrow cross-section. The floating spring mechanisms also have a sleeve acting against the presser plate of the spring such that an axial force pulling the centralizer apparatus into a borehole is transferred directly into a force on the spring, thereby reducing the opening moment the springs exert on the centralizer arms, making them easier to close.

BRIEF DESCRIPTION OF THE DRAWINGS

The invention will now be described in more detail, by way of example, with reference to the drawings in which.

DESCRIPTION OF THE PREFERRED EMBODIMENT

Figure 1:
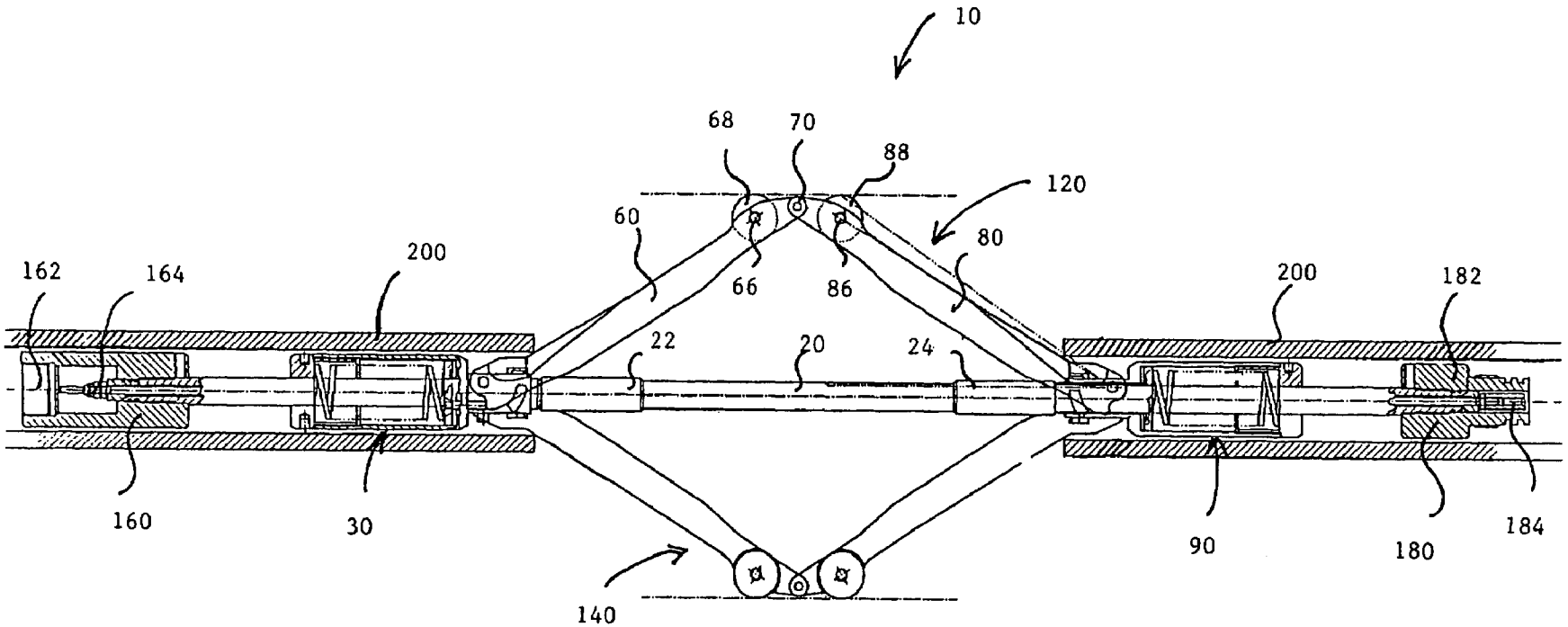
FIG. 1 shows a centralizer, according to a preferred embodiment of the invention, with centralizer arms partially open, entering a section of borehole with narrower diameter.

The preferred centralizer instrument 10, illustrated in FIG. 1, comprises a central mounting tool rod 20, on which floating spring mechanisms 30 and 90 are free to move between thrust transfer collars 22 and 24 and rod terminations 160 and 180 respectively.

Rod terminations 160 and 180 comprise coupling receptor 162 and electrical jack 164, and coupling jack 182 and electrical socket 184, respectively, and serve to facilitate secure physical and electrical connection of the centralizer tool to neighbouring instruments in the tool-string. Electrical connections between tools in the wireline toolstring are necessary in order to provide each tool with electrical power. Power is supplied from the surface to the toolstring via a co-axial cable which runs along the centre of the wireline itself; the electrical connections between the tools complete the circuit.

It will be understood, therefore, that terminals 160 and 180 form a complimentary receptor-connector pair which is common to any tool designed for integration into the tool-string. Coupling receptor 162 receives the coupling jack, like that shown at 182, of an adjacent tool rod to form a secure physical connection; at the same time electrical jack 164 of the terminal 160 is received by electrical the electrical socket 184 of the adjacent rod to form a secure electrical connection.

The preferred embodiment of the centralizer 10 further comprises four centralizer arm-pairs disposed around the central mounting tool rod at 900 intervals. For clarity, FIG. 1 shows only the two arms-pair 120 and 140 that lie in the plane of the drawing. There are also two further arm-pairs perpendicular to the plane of the drawing. Throughout the following discussion reference will only be made to the components and mode of operation of arm 120, but it is to be understood that the other arms are identical, and such references apply equally to the other three arms.

The arm-pair 120 comprises two arm sections 60 and 80, connected at hinge joint 70 to form a jointed arm pair assembly. Roller wheels 68 and 88 are mounted on bearings 66 and 86 situated proximate to the jointed ends of each respective arm section 60 and 80 and equidistant from hinge joint 70.

Figure 2:
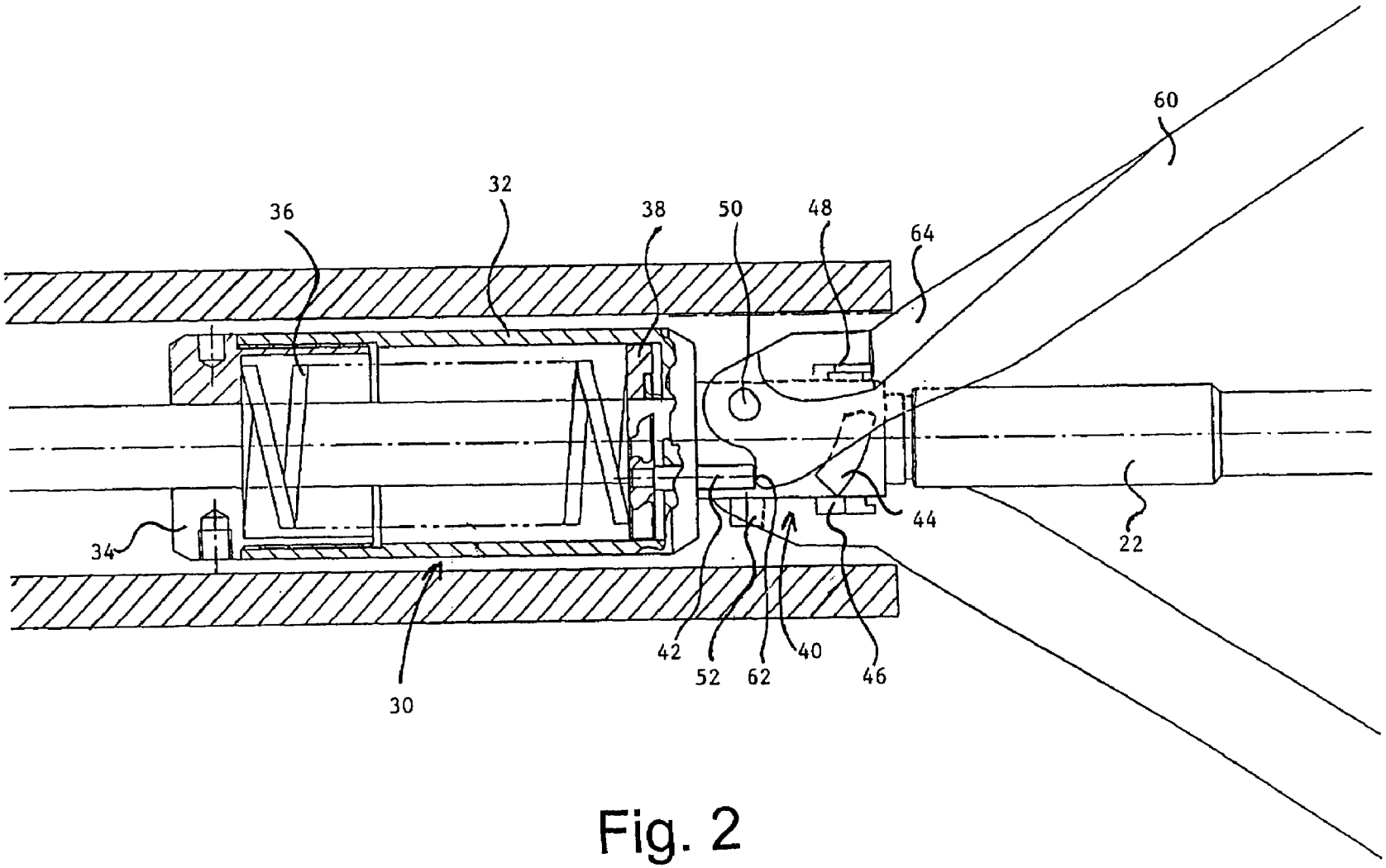
FIG. 2 shows the floating spring and mounted pivot arrangement of the centralizer of FIG. 1.

FIG. 2 shows how arm section 60 is attached to section 40 of the floating spring mechanism 30. The end of arm section 60 distant to the roller wheel hinges about pivot pin 50 disposed upon the arm mounting section 40 of the floating spring mechanism 30. The arm section 60, rotating about pivot pin 50, is guided in its motion by a lip of guide 44. The lip of guide 44 co-operates with a groove cut into the underside of the arm. The groove is not visible in the drawings. The jointed arm pair 120 is therefore free to open and close in a lateral direction.

Guides 46 and 48 shown for the two arm-pairs out of the plane of the drawing are identical in shape to guide 44 but are seen in profile. Pivot Pin 52, for the arm coming out of the plane of the drawing towards the observer, can also be seen on the underside of arm-mounting-section 40.

The arm-mounting section 40 is formed integral to housing 32 of the floating spring mechanism 30. The floating spring mechanism is constrained to axial movement in a longitudinal direction of the instrument by mounting tool rod 20 which passes through the centre of end plate 34, spring 36 and housing 32. Contained within the housing and kept under compression by end plate 34 is spring 36, the end of the spring away from the end plate 34 bears against presser plate 38.

The end of arm-section 60 hinged at the pivot pin 50, has cam 62 which engages actuator rod 42. The actuator rod is in turn connected to presser plate 38, so that as the arm-section 60 pivots in a clockwise direction about pivot pin 50, cam 62 acts on actuator rod 42 and pushes presser plate 38 against the spring 36, causing it to compress.

It is understood that this pivot and spring arrangement is identical but mirrored for the end of arm-section 80 where it is connected to floating spring mechanism 90, and that the same pivoting arrangement is employed for the other three arm-pairs as for arm 120.

Figure 3:
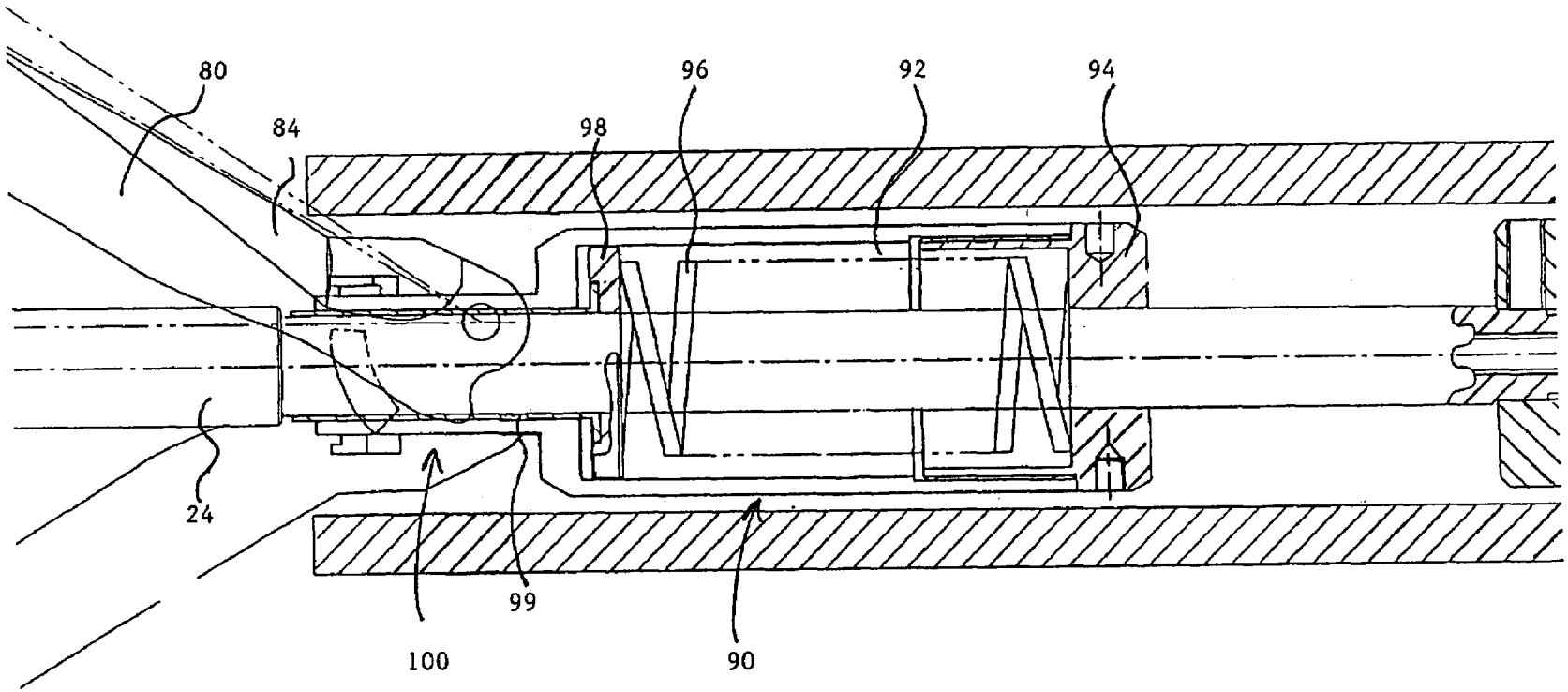
FIG. 3 shows a floating spring and mounted pivot arrangement of the centralizer of FIG. 1 in a different view.

Referring to FIG. 3, it can be seen that the floating spring mechanism 90 of the preferred embodiment, having a housing 92 and an end plate 94, has a sleeve 99 acting as a linkage connected to the presser plate 98 of the spring 96. The sleeve is free to slide axially through the arm mounting section 100 of floating spring mechanism 90 and extends a little beyond the arm mounting section 100, such that if the floating spring mechanism is caused to engage the thrust transfer collar 24, the sleeve 99 will be engaged first and will be pushed axially inwards, causing the presser plate 98 to compress the spring 96.

The two mechanisms 30,90 are of the same construction. The floating spring mechanism 30 also has a sleeve, corresponding to sleeve 99, connected to the presser plate 38 and which extends beyond the arm mounting section 40, as described above, however this cannot be seen from the view in FIG. 3. Equally, the floating spring mechanism 90 includes actuator rods or pins 42 which co-act with the cam 62. However these cannot be seen in the view of FIG. 3.

The mode of operation of the preferred embodiment will now be described.

FIG. 1 shows a centralizer instrument travelling through two pipes 200. In between the two pipes 200 is a region of larger diameter against which the centraliser arms of the arms are shown in contact. This arrangement is for illustration only and is intended to simulate the situation in which the centraliser is about to be drawn into a borehole of narrower diameter from a borehole of larger diameter. The narrower borehole is shown in the diagram as pipes 200. Clearly, if the centraliser is drawn to either the right or the left it will be forced into the restriction of the narrower borehole 200.

Terminals 160 and 180 of the centralizer 10 are connected to the corresponding terminals of adjacent tool rods in the tool-string, though these are not shown. The tool rods at the ends of the tool-string are connected to a cable or wireline which serves to draw the tool-string through the oil well. In the illustrated example the instrument is being drawn to the left.

Figure 6A:
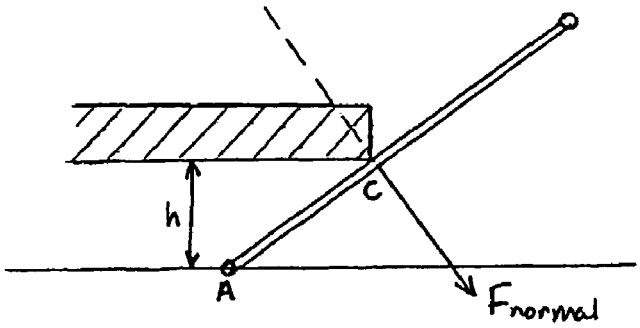
FIG. 6A shows the forces acting on a straight centralizer arm in the absence of friction.

As the centralizer 10 is drawn inside narrow borehole section 200, the edge of leading extended arm-section 60 contacts the edge of the narrow borehole and experiences a centralizing force which pushes the arm downwards against the action of spring 36. FIG. 6C illustrates the forces acting on the arm and centralizer. In the absence of friction the force experienced by the arm would be normal to the arm surface, however since the arm slides against the forward-most edge of the narrower borehole, a frictional force acts tangentially. The resolved centralizing forcer as a result of friction, therefore acts at an angle $\phi$ to the normal.

The centralizing force acting on arm-section 60 pushes the arm downwards, causing the arm-pair 120 to flatten and close as it moves in towards the central longitudinal axis of the instrument; as the arm-pair 120 flattens the floating spring mechanisms 30 and 90 are subsequently pushed axially along the tool mounting rod towards their respective terminal ends 160 and 180.

Furthermore, as the arm-pair flattens and arm-section 60 pivots about pivot pin 50, cam 68 of the arm-section pushes against actuator rod 42 connected to spring plate 38. In this way, the torque about pivot pin 50, supplied by the centralizing force from the narrow borehole wall, is transferred via the cam, actuator rod and spring plate to a compressive force on spring 36, and so the spring is compressed. The same is true as arm section 80 pivots around its pivot pin mounted on the floating spring mechanism 90, causing the spring 96 therein to compress.

The bias of the compressed springs 36 and 96 is therefore to push the jointed arm-pair 120 outwards and keep the roller wheels 68 and 88 in contact with the outside wall of the borehole.

The floating spring arrangement employed in the preferred embodiment for biasing the centraliser arms to open outwards has many advantages over the end spring biasing arrangement employed in known prior art centralisers.

In such centralisers, the centralising arms are given an outward bias by the use of an end spring; one end of the spring is attached to the end of the tool casing and the other is usually attached to a mount with pivot points to which the centraliser arms are attached. The mount is adapted to slide along the body of the tool against the action of the spring. There are however many disadvantages with this design, not least for example, when the centraliser arms are fully closed the bias opening force provided from the end springs no longer acts to push the arms outwards. Also any opening force provided by the spring acts on the mount to which the arms are attached, and not on the arms themselves, and furthermore that this force acts longitudinally along the tool body rather than to turn the arms outwards.

The design of the preferred embodiment dispenses with end springs altogether and instead provides floating spring mechanisms. The spring 36 of the floating spring mechanism, through the presser plate 38, actuator rod 42 and cam 62, exerts an opening force on the arms directly, not on the mount as in prior art designs. Moreover, through the positioning of the cam 62 to one side of the pivot 50, the longitudinal force from the spring 36 is converted directly to a turning moment about the pivot.

Figure 4:
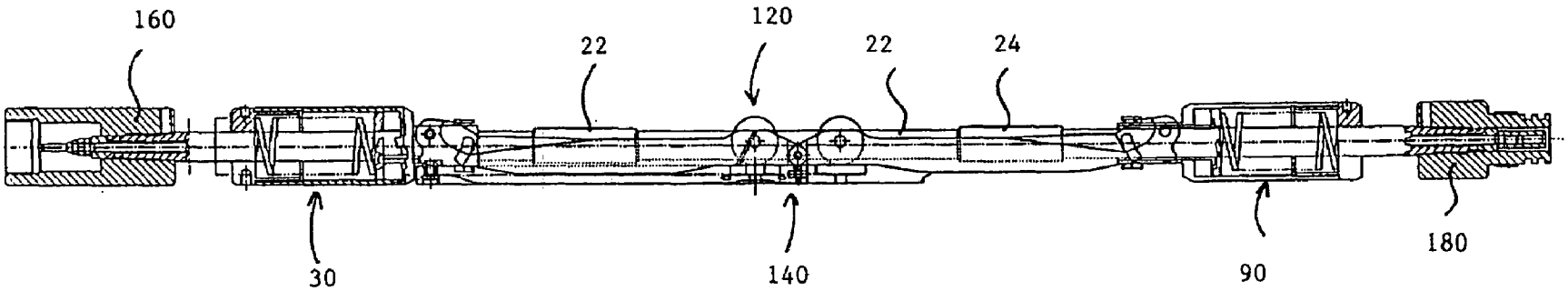
FIG. 4 shows the centralizer of FIG. 1, with centralizer arms fully closed.
Figure 5:
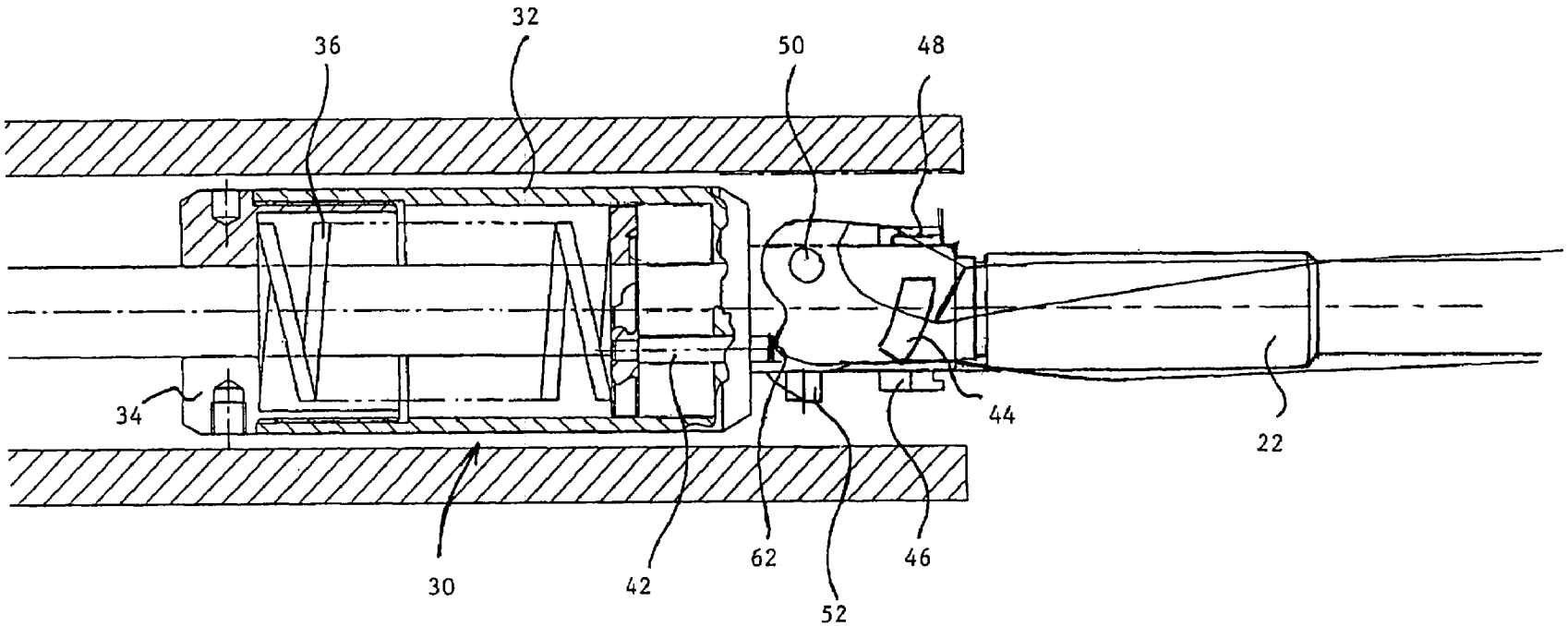
FIG. 5 shows a floating spring and mounted pivot arrangement of the centralizer shown in FIG. 4.

The arrangement of the arm-pairs 120 and 140, the position of the floating spring mechanisms 30 and 90 and the position of springs 36 and 96 are all shown in a flattened aspect, as would be the case when the instrument passes through an extremely narrow aperture, in FIG. 4.

If the instrument were to pass from the narrow borehole into a borehole of larger diameter then the compressed jointed arm-pair 120 is no longer constrained by the outside wall of the borehole; the action of compressed spring 36, against the cam of the arm-section 60, causes arm-section 60 to pivot anticlockwise and outwards around pivot pin 50, while similarly the action of compressed spring 96, against the cam of the arm-section 80, causes arm-section 60 to pivot clockwise and outwards around its pivot pin, such that roller wheels remain in contact with the wall of the wider borehole.

The arm sections of each jointed arm pair are so orientated as to advantageously provide a shallow angle of attack in order to facilitate easy closing.

The jointed arm-pair 120 of the preferred embodiment has twin roller wheels 68,88 connected either side of a central pivot 70. This configuration advantageously provides a smoother passage, than for example a single roller wheel, especially if the surfaces of the borehole are irregular. The centralizing force exerted by the leading wall of the borehole on the arm-section is due to the pull-in force provided by the wireline or cable. Since this is limited by the maximum load the cable can bear the preferred embodiment is provided with a number of features to advantageously increase the centralizing force on the arm-section per unit of pull-in force provide by the cable.

The arm-section 60 of the preferred embodiment shown in FIG. 1 has a concave profile or indentation 64 that advantageously increases the closing force exerted on the jointed arm-pair 120 by the centralizing force from the borehole wall.

Figure 6B:
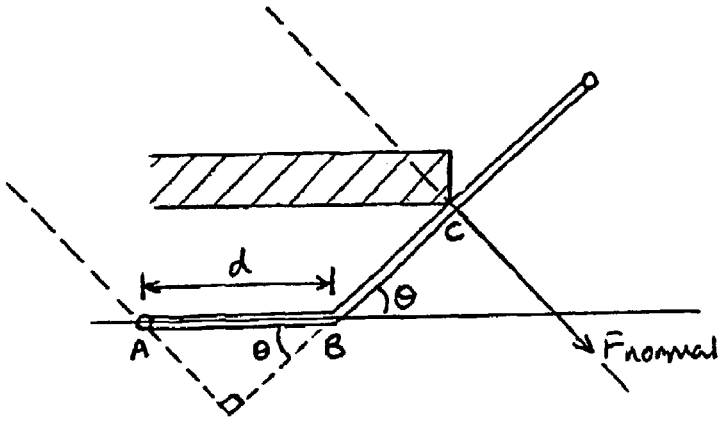
FIG. 6B shows the forces acting on a centralizer arm of the preferred embodiment in the absence of friction.
Figure 6C:
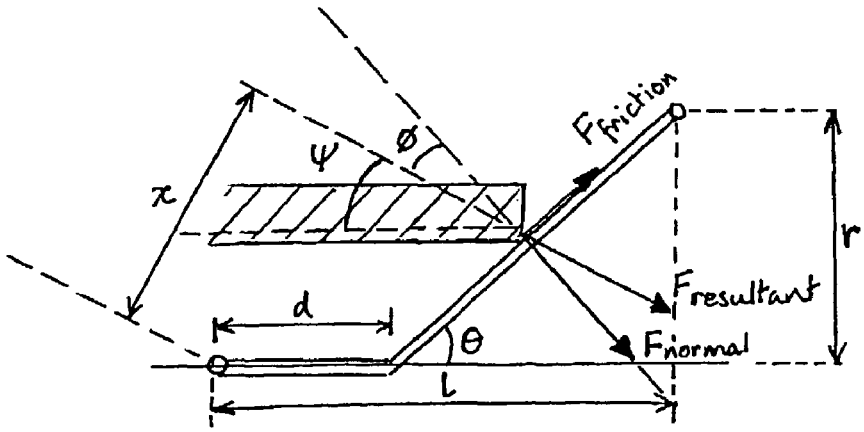
FIG. 6C shows the forces acting on the centralizer arm of the preferred embodiment in the case where friction is considered.

Referring to FIG. 6B, the arm-section 60 of the preferred embodiment can be seen to have a kink which serves to lengthen the effective length of the arm between the pivot and the point of action of the centralizing force. This is a schematic diagram but it illustrates the basic principles.

For the sake of simplicity, in the following discussion we will ignore friction so that the closing force acts simply normal to the arm section.

If the arm-section 60 were to be simply straight, as shown in FIG. 6A, then the centralizing force exerted by the borehole wall, where it contacts the arm-section at point C, would exert a torque about the pivot pin at A, equal to the product of the force times the distance between points A and C, that is from point of action to the pivot.

The arm-section 60 of the preferred embodiment, shown in FIG. 6B, however, includes a kink at point B, from which the arm extends at an angle θ. The distance at which the centralizing force acts is now given by the distance BC+AB cos θ. For the same magnitude of centralizing force, the design of the preferred arm-section results in a greater torque around the pivot pin, and therefore results in a jointed arm-pair arrangement that is easier to close.

The situation in which a frictional force is considered is shown in FIG. 6C. In this situation the distance x at which the resultant force acts can be shown to be:

$$x = \frac{h}{\sin(\theta + \phi)} + (d - h \cdot \cot(\theta + \phi) + h \cdot \cot\theta) \cdot \sin\varphi \tag{1}$$

where d is the distance between the pivot and the bend in the arm; h is the clearance of the borehole wall from the centre pivot; θ is the angle at which the arm is bent; ϕ is the angle of friction at which the resultant force from the borehole wall acts on the arm section and ψ is the angle the line of the resultant force makes with the horizontal.

Referring to FIG. 6C, $$\theta = \arctan\left(\frac{r}{l - d}\right) \tag{2}$$

where dimensions r and l are fixed by operational constraints.

It can be shown that the net closing moment M due to an axial cable pull P is given by:

$$M = \frac{P}{\sin(\phi + \theta)} \cdot x \tag{3}$$

P being limited by the cable strength. The centralizing force corresponding to this moment is given by:

$$CF = \frac{M}{l} \tag{4}$$

The usefulness of the design will be seen to depend on the "Pull-in Factor" defined by the ratio P/CF. We have appreciated that it is particularly advantageous to minimize this ratio.

Combining equations (3) and (4), gives:

$$\frac{P}{CF} = \frac{l \cdot \sin(\phi + \theta)}{x} \quad (5)$$

Figure 7:
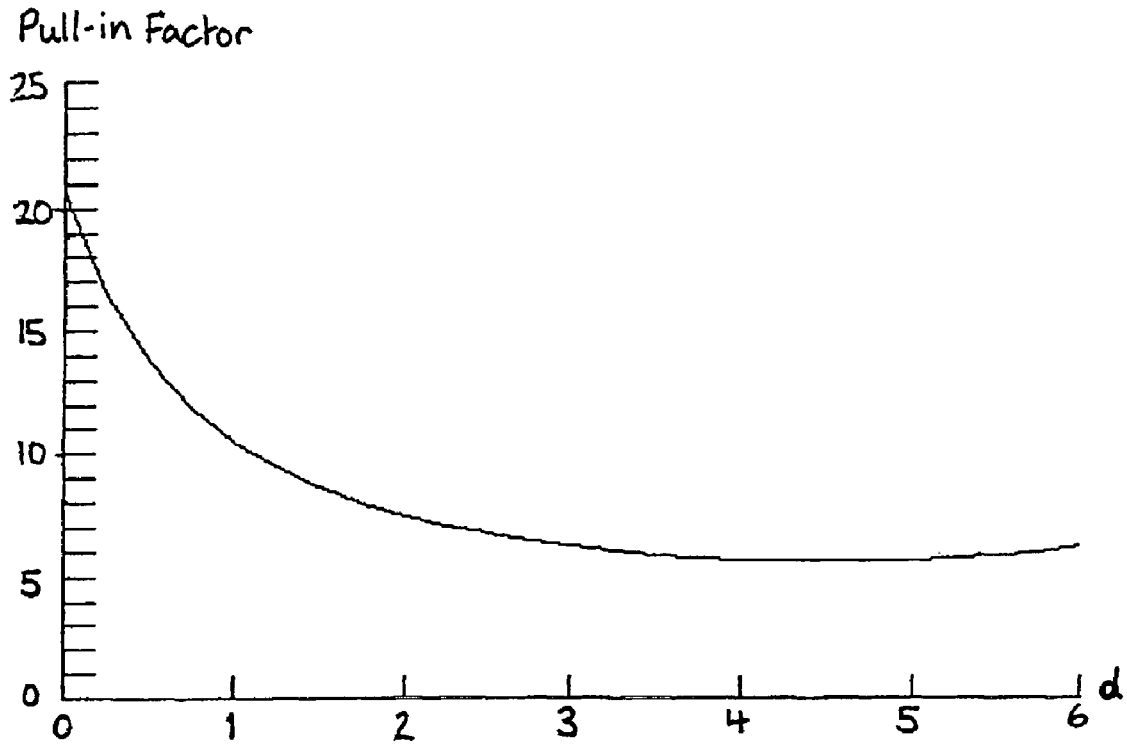
FIG. 7 shows a graph of the Pull-in Factor, that is the ratio of the Pull-in force to the centralizer force, plotted as a function of d, the distance from the pivot to the bend in the centralizer arm as shown in FIG. 6C.

This is plotted against d in FIG. 7 for the simple design of FIG. 6C, using values of 1=12 inches, r=6 inches and h=0.25 inches.

It is seen, in this example, that if d is 2 inches or greater, an advantageously small Pull-in Factor is obtained; that is, as much as possible of the pull-in force exerted by the wireline or cable is advantageously transferred into a centralizing force on the centralizer arms.

The actual arm profile 64 of arm-section 60 clearly need not be limited to such a simple case, and in the preferred embodiment, the ergonomic design illustrated in FIG. 6B is incorporated into the arm by a cut out section.

Figure 8:
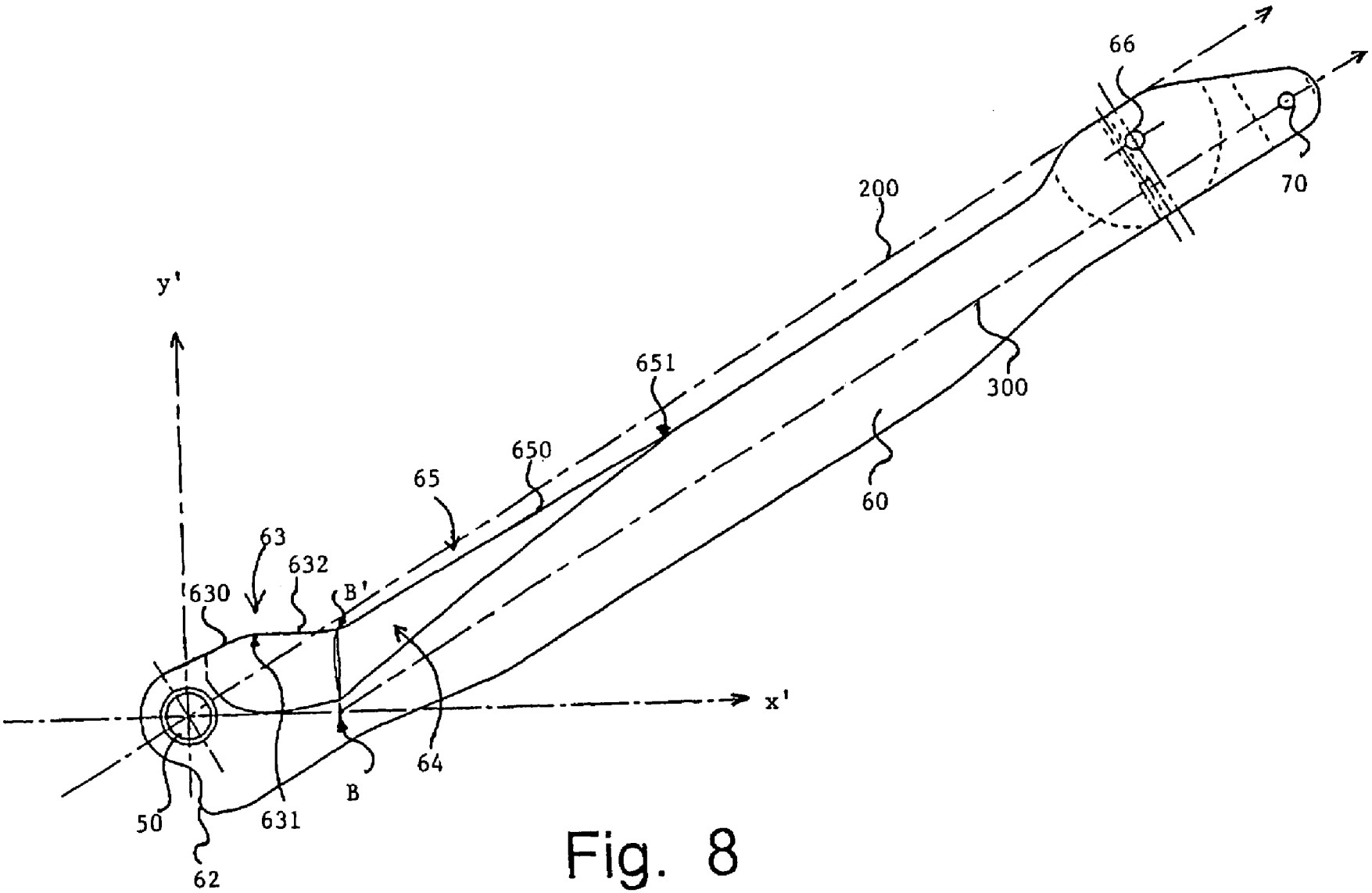
FIG. 8 shows a side view of an arm of the preferred centraliser tool, and illustrates the preferred arm profile.

FIG. 8, to which reference should now be made, shows the preferred profile of the centraliser arm in more detail.

The arm section 60 has a longitudinal axis 200 which passes through pivot 50 and extends along the arm substantially parallel to both the top and bottom sides of the arm. For ease of reference, FIG. 8 includes an x' and a y' axis which represent the horizontal and vertical respectively. These are labelled with primes to avoid confusion between x' co-ordinates and the variable x mentioned above which represents the perpendicular distance at which the closing force acts from the pivot 50. Thus, it will be appreciated that the arm section of FIG. 8 is shown angled as it might be in use, when it is biased to open through cam 62 and the spring 36 of the floating spring mechanism. In the preferred embodiment the axis 200 is angled at 31° to the x' axis.

If the arm section had a substantially straight profile along its entire length and had no cut-out section like that of the preferred embodiment, then the axis 200 would lie substantially centrally within the arm and would run substantially parallel along the arm length.

However, in the preferred embodiment, for most of the length of the arm section, the arm's top side or leading edge, that is the edge which will make contact with any restriction in the borehole, lies behind this axis. The leading edge of the arm section extends forward of the axis only at the end of the arm section that bears the pivot 50, so that the pivot may be accommodated more centrally with respect to the arm cross-section. The leading edge of the arm meets this axis at the end which mounts the rollers and runs parallel to it proximate the pivot 66 on which the roller wheel 68 is mounted. The actual position of the roller pivot is just behind the axis 200. The hinge 70 at which the arm section 60 is connected to the other arm section 80 to make up the arm pair 120 is also positioned behind the axis 200.

Placing the leading edge of the centraliser arm section behind this axis means that a force acting on the leading edge produces a greater moment on the arm section about the pivot than if the arm section had a straight leading edge extending directly from the pivot and along the axis, as will be understood from the above discussion for FIGS. 6A to 6C.

Placing the leading edge behind the axis also allows the centraliser arm to present a shallower angle of attack to any restriction which is encountered. A shallower angle of attack means that the frictional force between the arm and any restriction is smaller.

As was shown in FIGS. 6A to 6C, the action of friction causes the closing force exerted on the arm by any restriction to act in a direction that is deflected away from the normal to the arm profile at the point of contact. This deflection tends to result in a closing moment about the axis that is less effective the more friction acts.

The arm section's shallow angle of attack, by reducing the frictional force acting on the arm, advantageously reduces wear-and-tear on the arm, as well as ensuring that the closing force on the arm is converted to a closing moment that is as large as possible.

The leading edge of the arm section is caused to lie behind axis 200 by the cut-out or concave section 64. This section is comprised of two regions 63 and 65 which are cut into the top side or leading edge of the arm. The two regions meet at point B', which it will be seen, corresponds to the kink, labelled as B, in the straight arm profile shown in FIG. 6B.

The location of point B, corresponding to the kink in the straight arm profile is shown on the x' axis. A line 300 connects this point to hinge 70 and to the pivot 50 to indicate the simplified arm geometry shown in FIG. 6B positioned as it would be if it were to be mapped onto FIG. 8.

The first region 63 of the concave section 64 begins proximate the pivot 50 and has a top side or leading edge formed of two surfaces which are contiguous with each other. The first of these 630 extends substantially parallel to the axis 200 and to the underside of the arm until it reaches point 631, at which second surface 632 continues at an angle such that it intersects and extends beyond and behind axis 200 to point B'.

At point B' the second region 65 begins. It has a top side or leading edge that is formed in a single surface 650, that continues away from axis 200 but at an angle that is more gentle than that for the second surface 632, until it reaches point 651 at which it ends. Point 651 is further behind the axis 200 than point B'.

After point 651 the arm profile extends substantially straight and parallel to the axis 200 until it reaches the region proximate the bearing 66 for the roller wheel where it slopes back up towards the axis 200 to provide clearance for mounting the bearing 66.

As was discussed earlier the parameter of the arm geometry which most affects the Pull-In factor is the position of point B, that is the position at which the kink occurs in the straight arm geometry shown in FIG. 6B. The distance (d) from the pivot to the point B is plotted in FIG. 7 against the Pull-In Factor. The curve of this graph depends on the length of the arm projected horizontally (l), the reach of the arm projected vertically (r) and the clearance of the borehole wall from the centre pivot.

In FIG. 7, for values of 1=12 inches, r=6 inches, and h=0.25 inches, the optimum value of d is seen to be greater than 2 inches. In practice, however, the need for the closed centraliser arm to fit within the tool body envelope may restrict the choice of d to a lesser value than the optimum. This is acceptable since most of the improvement in the Pull-In Factor is obtained for values of d that are small.

In the preferred embodiment shown in FIG. 8, the value for d is 1 inch; the arm itself has an length measured along axis 200 from pivot 50 to hinge 70 of approximately 8.5 inches and a lateral reach, measured along the y' axis from pivot 50 to hinge 70 of approximately 3.9 inches; also the point 651, up to which the second region 65 of the concave section extends, is located approximately 3.8 inches from the pivot 50 measured along the arm axis 200.

Once the best practical value of d is known, the profile of the two regions 63 and 65 may be described according to the following formula. Taking x' as the horizontal position of an element of surface and y' as the vertical position of an element of surface measured from the pivot 50, then for x'<d, ie for the profile of the first region, the condition that y'<h is required to hold true. This may be seen from FIG. 8, in which the profile of the second surface 632 adjacent point B' is substantially straight and parallel to the x' axis. The first surface 630 extends substantially parallel to axis 200 so that the profile of the arm around the pivot 50 follows the line of the pivot and so juts out less.

For x'>d, ie for the surface of the second region 65, the surface is defined by requiring that the following condition hold true:

$$\arctan\left(\frac{x'}{y'}\right) - \arctan\left(\frac{dx'}{dy'}\right) \leq \frac{\pi}{4} \tag{6}$$

This condition results in the angle of attack of the arm profile in region 65 always being less than 45°, assuming the restriction is substantially horizontal; that is to say that any horizontal restriction will encounter the arm profile at 45° or less relative to the arm's tangent. This may be understood as follows. The casing of the borehole may be assumed as straight line drawn from the pivot 50 to a point on the centraliser arm. In practice of course, the casing should be drawn at a distance of h from the pivot; however h is small in comparison to the other parameters of the arm section and so may be ignored to a reasonable approximation. The angle between this line and the y' axis is given by the first term of equation 6, ie arctan (x'/y'). The second term of the equation 6, is the angle made between the tangent to the arm section at the point of contact and the y' axis. This angle is given by the expression arctan(dx'/dy'). Thus equation 6 requires that the difference in the angle between these two lines is less than or equal to 45°.

The value of 45° has been chosen in the preferred embodiment because it has been found sufficient to avoid significant friction; it is possible that other angles would work equally as well.

The preferred concave section of the arm has been described above as comprising two sections 63 and 65, the second section having a surface which curves according to equation 6. The concave section may however be approximated by using substantially straight sections, rather than sections which curve, in order to make manufacture more easy for example, providing the leading edge of the arm section is placed behind axis 200.

The cross-sectional profile of the arm has not been discussed so far. For the purposes of the advantages described above, it is sufficient to say that the cross-section is circular. In practice however, the arm profile will be complicated by the fact that the arms are connected to the tool body at pivots located on either side of the tool body, but are connected to each other over the centre of the tool itself. The complicated cross-sectional geometry of the arm does not need to be discussed further here.

It is appreciated that the arm profile 64 is a common feature of each arm section of each jointed arm pair proximate to the pivot pin of the floating spring mechanism.

The central mounting rod of the preferred embodiment is provided with thrust transfer collars 22 and 24 at fixed locations equidistant from the rod centre and furthermore has sleeves connected to each of the springs of the floating spring mechanisms. The thrust transfer collars and sleeves allow the pull-in or entry forces to directly assist in compressing the spring of the leading floating spring mechanism, and thereby cause the jointed arm-pairs 120 and 140 to flatten and close more easily. This can be understood with reference to FIG. 3 which shows the floating spring mechanisms from in a different view, allowing the sleeve 99 to be seen. In FIG. 3 we will assume, for convenience, that the centralizer is being drawn into the borehole to the right.

The thrust transfer sleeve 99 is mounted on the presser plate 98 of the spring in each floating spring mechanism, and is able to slide freely inside the pivot section and floating spring mechanism as the spring is compressed or as it extends. The thrust transfer sleeve extends a little way beyond the end of the pivot section 100 of the floating spring mechanism 90. Other arrangements may be employed to transfer the thrust from the central mounting tool rod 20 to the presser plate 98 for the spring 96.

A pull-in force applied to the tool rod to draw it to the right will cause the rod and thrust transfer collars, but not the floating spring mechanisms, to move to the right also. In a centralizer without the thrust transfer sleeves 99, the leading thrust transfer collar 24 may therefore be caused to engage and act directly upon the floating spring mechanism 90 to push it into the narrow borehole, thereby assisting the closing force acting on the arms of the centralizer from the wall. At the same time of course, the lagging thrust transfer collar 22 is pulled away from the lagging floating spring mechanism 30 and, therefore, plays no role in assisting the closing force.

However, in the preferred embodiment, the thrust transfer sleeve 99 is engaged by the thrust transfer collar 22,24 before it meets the arm maintaining section 100 allowing the axial pull-in force to act directly on the spring of the leading floating spring mechanism 90.

The pull-in force applied to the tool rod will cause the leading thrust transfer collar 24 to approach the leading floating spring mechanism 90 until it engages the thrust transfer sleeve 99. Further motion to the right, caused by the pull-in force, causes the leading thrust transfer collar 24 to act on the thrust transfer sleeve 99 and consequently the presser plate 98, thereby compressing the spring 96. The opening force exerted on the jointed arm-pairs by the spring is thereby reduced making the arms more easy to close by the force acting on the arm from the wall of the borehole.

The same discussion applies in the case of the floating spring mechanism 30 should the centraliser tool be travelling in the opposite direction. In this case, floating spring mechanism 30 is the leading spring mechanism, and the thrust transfer collar 99 of the floating spring mechanism 30 is acted upon by central collar 22.

Although the preferred embodiment described has four jointed arm pair assemblies, it is appreciated that three or more arms pairs could be used to provide sufficient stabilizing force.

The invention claimed is:

1. A centralizer apparatus comprising:

a central mounting rod;

two floating spring mechanisms mounted on the central mounting rod and free to move along at least part of its length;

three or more jointed arms, spaced around the central mounting rod, each arm being made up of two arm sections of equal length connected by a hinge, the end of each arm section distant to the hinge being connected to a pivot on a respective floating spring mechanism, such that the jointed arm is suspended between the two floating spring mechanisms and can open or close in a lateral direction;

each jointed arm being adapted proximate to the hinge for engaging the wall of a borehole;

the floating spring mechanisms each comprising a spring which in its entirety is axially movable, and means to transfer an axial force from the spring to a rotational force about the pivot on each of the jointed arm sections, such that they are biased to open laterally;

blocking means attached to the mounting rod; and a linkage connected to the spring of the floating spring mechanism, the linkage being disposed to engage the blocking means of the mounting rod before the floating spring mechanism is engaged by the blocking means, thereby transferring an axial force acting on the mounting rod to a force acting on the spring of the floating spring mechanism.

2. The centralizer apparatus of claim 1, wherein the blocking means is a collar disposed on the mounting rod inside of each floating spring mechanism.

3. The centralizer apparatus of claim 2, wherein each floating spring mechanism comprises a presser plate, which acts on the end of the spring that is proximate to the pivot.

4. The centralizer apparatus of claim 3, wherein the linkage comprises a sleeve, attached to the presser plate, which extends through the floating spring mechanism to beyond the mechanism's inside edge, the sleeve being disposed to move axially against the spring and be acted upon by the blocking means to act on the spring.

5. The centralizer apparatus of claim 3, wherein the linkage comprises a sleeve attached to the presser plate and extending axially in the floating spring mechanism, said sleeve being configured to extend axially beyond a terminal edge portion of the floating spring mechanism when said floating spring mechanism is in an initial non-compressed state such that said sleeve engages said blocking means and begins to act on said spring prior to engagement of the floating spring mechanism with the blocking means.

6. The centralizer apparatus of claim 2, wherein the means for transferring an axial force from the spring of the floating spring mechanism to a rotational force about the pivot on each of the jointed arm sections includes a presser plate and further comprises:

a cam disposed at the end of the arm sections of the jointed arm pairs where they are connected at the pivots of the floating spring mechanisms; and an actuator rod which engages the cam and which is connected to the presser plate; whereby an axial force provided by the spring is transferred via the cam, actuator rod and presser plate to a rotational force about the pivot which biases the jointed arms to open laterally, and such that a force exerted on a jointed arm by the wall of a borehole is caused to act on the spring.

7. The centralizer apparatus of claim 1, wherein said spring of each said floating spring mechanism in its entirety is axially movable relative to the central mounting rod along at least a portion of its length.

8. A centralizer apparatus comprising:

a central mounting rod;

two floating spring mechanisms mounted on the central mounting rod and free to move along at least part of its length;

three or more jointed arms, spaced around the central mounting rod, each arm being made up of two rigid arm sections of equal length connected by a hinge, the end of each arm section distant to the hinge being connected to a pivot on a respective floating spring mechanism, such that the jointed arm is suspended between the two floating spring mechanisms and can open or close in a lateral direction;

each jointed arm being adapted proximate to the hinge for engaging the wall of a borehole;

the floating spring mechanisms comprising a spring, and means to transfer an axial force from the spring to a rotational force about the pivot on each of the jointed arm sections, such that they are biased to open laterally;

wherein at least one of the arm sections comprises a concave profile cut out of the section adjacent the pivot such that a force applied to the profile is caused to act further away from the pivot than it would if the concave profile was not cut out of the section.

9. The centralizer apparatus of claim 8, wherein the concave profile has a section defined approximately by the mathematical formula:

$$\arctan\left(\frac{x}{y}\right) - \arctan\left(\frac{dx}{dy}\right) \leq \frac{\pi}{4}$$

where x and y represent the x and y co-ordinates of an element of the surface of the section measured relative to a horizontal and vertical axis centered about the pivot.

* * * * *